United States Patent [19]

Rood et al.

[11] 4,355,764

[45] Oct. 26, 1982

[54] LOW CAPACITANCE AIRLESS SPRAY APPARATUS

[75] Inventors: Alvin A. Rood, Oberlin; Donald R. Hastings, Elyria, both of Ohio

[73] Assignee: Nordson Corporation, Amherst, Ohio

[21] Appl. No.: 169,850

[22] Filed: Jul. 17, 1980

[51] Int. Cl.[3] ..... B05B 5/02

[52] U.S. Cl. ..... 239/708; 239/600

[58] Field of Search ..... 239/3, 690, 691, 696, 239/697, 698, 704–708, 600

[56] References Cited

U.S. PATENT DOCUMENTS

| | | | |
|---|---|---|---|
| 3,056,557 | 10/1962 | Walberg | 239/424 |
| 3,248,059 | 4/1966 | Fischer et al. | 239/707 |
| 3,253,782 | 5/1966 | Fischer et al. | 239/707 |
| 3,265,306 | 8/1966 | Fischer et al. | 239/707 |
| 3,425,625 | 2/1969 | Probst | 239/707 |
| 3,677,470 | 7/1972 | Probst et al. | 239/707 |
| 3,705,693 | 12/1972 | Franz | 239/600 |
| 3,731,145 | 5/1973 | Senay | 239/708 |
| 3,737,099 | 6/1973 | Shaffer | 239/707 |
| 3,750,949 | 8/1973 | Luderer et al. | 239/698 |
| 3,767,115 | 10/1973 | Kozinski | 239/707 |
| 3,815,820 | 6/1974 | Probst | 239/707 |
| 3,851,899 | 12/1974 | Franz | 285/95 |
| 4,066,041 | 1/1978 | Buschor et al. | 239/708 |
| 4,241,880 | 12/1980 | Hastings | 239/691 |
| 4,244,527 | 1/1981 | DeFusco | 239/691 |
| 4,245,784 | 1/1981 | Garcin | 239/708 |
| 4,266,721 | 5/1981 | Sickles | 239/3 |

*Primary Examiner*—Robert B. Reeves
*Assistant Examiner*—Michael J. Forman
*Attorney, Agent, or Firm*—Wood, Herron & Evans

[57] ABSTRACT

An airless electrostatic spray gun for atomizing and electrostatically depositing liquid coating materials onto substrates. The gun is characterized by a low capacitance which enables the electrode of the gun to be shorted to a grounded object without the resulting spark having sufficient energy content to ignite the surrounding atmosphere.

19 Claims, 2 Drawing Figures

POWER SUPPLY
LIQUID SOURCE

LOW CAPACITANCE AIRLESS SPRAY APPARATUS

This invention involves apparatus for atomizing and electrostatically depositing coating material upon a substrate.

Commercial apparatus for atomizing and electrostatically depositing coating material commonly utilizes either airless or air atomization. In coating certain types of articles, as where a high coating material delivery rate is desired, or where there is a need to penetrate into a recess, for example, it is desirable to atomize the coating material without the presence of air, as by projecting the coating material through a small orifice under high pressure. The interaction of the stream of coating material with air causes a break-up or atomization of the coating material into small particles which may then be charged electrostatically. The electrostatic charge has the effect of improving the efficiency of deposition of the coating material onto the substrate.

Airless spraying apparatus commonly includes a nozzle defining an orifice through which liquid coating material under high pressure is directed, to be atomized into fine particles upon emergence from the nozzle and interaction with air surrounding the nozzle. An electrode or so-called antenna is commonly operably associated with the nozzle and connected with a source of high voltage to establish an electrostatic field in the vicinity of the region of formation of the sprayed particles. This electrostatic field is operable to impart a charge to the sprayed particles and effect an increased deposition of sprayed particles onto the article to be coated. The electrical circuit from the source of high voltage to the antenna commonly includes one or more resistors which limit current flow in the circuit and provide a safety factor by reducing the electrode voltage if the current increases.

It has been recognized, as in U.S. Pat. No. 3,815,820 that the high voltage circuit between the resistor and the antenna should have a small physical area exposed to the atmosphere and an appropriate configuration to limit the electrical capacity of the system and the energy which may be stored therein and rapidly discharged therefrom in the event that there is an inadvertent discharge of energy between the antenna and a grounded object. Such an inadvertent discharge often occurs when the gun is moved too close to a grounded workpiece or too close to a grounded wall of the spray booth within which the gun is operating. In that event, a spark arcs across the gap between the gun electrode and the grounded object, and if the spray atmosphere is explosive, may ignite that atmosphere.

While there have been previous efforts to minimize the "effective capacity" of airless electrostatic spray systems, and thus the danger of those systems igniting an explosive atmosphere, those efforts have not previously resulted in a gun having as low an "effective capacity" as is desirable and required for safe operation in an explosive atmosphere.

It has therefore been an objective of this invention to provide a new nozzle assembly for an airless electrostatic spray gun which has a lower "effective capacity" and consequently less available energy to cause ignition when shorted to ground than have prior art guns.

One aspect of this invention is predicated upon the discovery of a nozzle assembly configuration which enables the effective capacitance of an electrostatic airless spray gun to be reduced as much as ten-fold by isolating the antenna of the gun from the metallic spray nozzle. Heretofore it has often been considered necessary to maintain the antenna in contact with the nozzle, as in U.S. Pat. No. 3,737,099, in order to prevent arcing between the antenna and the metallic nozzle. We have found a novel nozzle assembly configuration wherein the antenna and the nozzle may be electrically insulated one from the other without the occurrence of sparks between the two and with a consequent substantial reduction in effective capacitance of the resulting gun.

Another aspect of the novel nozzle assembly configuration of this invention resides in the configuration of the seal between the barrel of the gun and the nozzle assembly which enables the antenna to be connected to the resistor of the gun without passing through or interfering with this seal. Specifically, this novel seal comprises a double truncated conical sealing plug located between the barrel and the nozzle and operable under high pressure spray conditions to maintain a seal between the gun barrel and the nozzle.

The primary advantage of this invention is that it provides an electrostatic spray gun which has an effective capacitance substantially less than prior art guns. Consequently, the gun has substantially less energy available to spark and ignite the surrounding atmosphere in the event that the gun is inadvertently shorted to ground or to an object of a different potential.

Additionally, the gun of this invention is economical to manufacture and simple in construction so that it is easy to clean, service and repair.

These and other objects and advantages of this invention will be more readily apparent from the following description of the drawings in which.

Figures 1, 2:
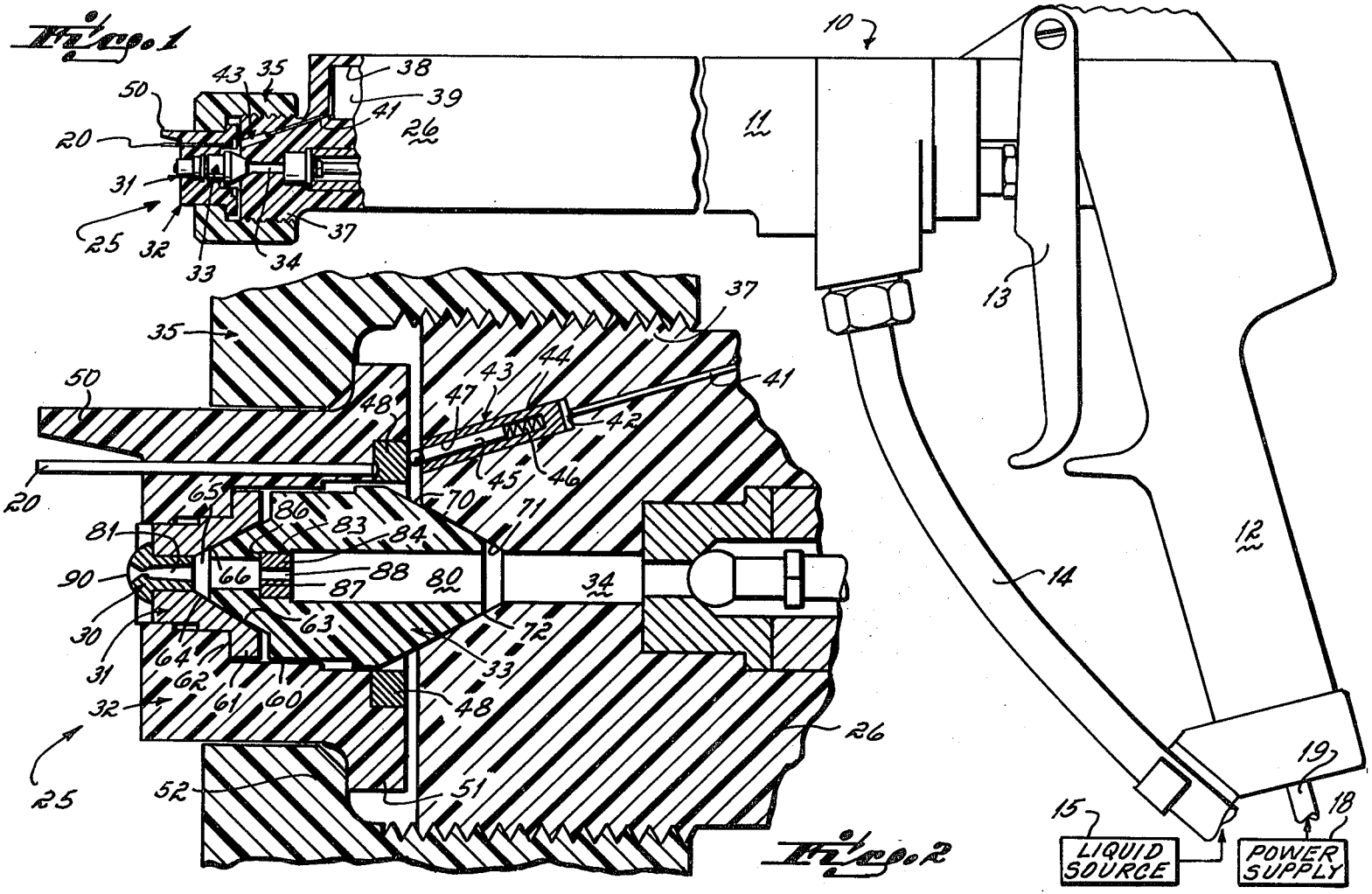
FIG. 1 is a partially diamgrammatic illustration of an electrostatic airless spray system incorporating the invention of this application.
FIG. 2 is an enlarged cross sectional view of the nozzle assembly portion of the gun illustrated in FIG. 1.

The embodiment of the invention illustrated herein includes a gun 10 adapted to be held in the hand of an operator. It should be understood though that the gun may be mounted on a robot or some other suitable structure, either fixed or movable, and actuated from a remote location.

With reference to the drawings, there is illustrated a coating system incorporating the invention of this application. In the practice of this invention, articles (not shown) may be carried by a conveyor past the nozzle of the gun 10. The gun 10 has a body 11, a handle 12, and trigger 13. A hose 14 connects the gun with a suitable source 15 of coating material under high pressure, usually on the order of 300–1000 psi. An electrical power supply 18 is connected with the gun 10 through a cable 19. This cable provides the power for creating an electrostatic field between an electrode 20 of the gun and the grounded articles to be sprayed. Atomized particles of sprayed material are charged in this field and are electrostatically deposited on the workpiece. Trigger 13 controls the discharge of coating material from the gun 10 and the application of high voltage power from the power supply 18 to the electrode 20.

The invention of this application resides in the forward end portion or nozzle assembly portion 25 of the gun 10. This portion of the gun is illustrated in FIG. 2. The remainder of the gun rearwardly from this portion has not been illustrated in detail in this application because it is conventional and has been previously described in U.S. Pat. No. 3,731,145, issued to Robert S. Senay on May 1, 1973, and assigned to the assignee of this application. The disclosure of this patent is incorporated by reference in this application for purposes of more completely describing the details of the gun 10.

The nozzle assembly 25 comprises the gun body extension 26, the nozzle 30 mounted within a nozzle adapter 31, a nozzle support ring 32, and a sealing plug 33 located between the nozzle adapter 31 and the gun body extension 26 for sealing a liquid flow passage which extends through the gun and to the nozzle 30. Additionally, the nozzle assembly 25 includes a nozzle retaining nut 35 for securing the nozzle supporting ring 32 onto the body extension 26.

The gun body 11 and extension 26 are made from an electrically non-conductive plastic material such as nylon. It is generally cylindrical in configuration and has an externally threaded boss 37 at its outer end. A central bore 34 extends axially through the extension 26 and body 11 into communication with the hose 14 through which high pressure liquid is supplied to the gun. A second passage 28 extends longitudinally through the gun body extension 26 and is offset from the liquid flow passage. This latter passage 38 houses the electrical circuitry and particularly the resistor 39 through which high voltage power is supplied to the electrode 20 mounted in the nozzle supporting ring 32. The inner connection between the resistor 39 and the electrode 20 comprises electrical contact pin 41 embedded in the body extension 26 and having an end 42 in contact with a brass contact 43. The contact 43 is mounted within a bore 44 of the body extension and has a metal contact pin 45 slideable therein. A spring 46 located between the end of the pin and the end of a blind recess or bore 47 of the contact maintains the contact pin 45 in engagement with an electrically conductive washer 48. In a preferred embodiment this washer is made from a Teflon material containing 15% to 25% graphite or carbon so that it is electrically conductive. By utilizing the washer 48 to maintain the electrical contact between the electrode 20 and the contact 43, the rotational position of the nozzle may be varied without breaking the electrical contact between the electrode and the contact.

The nozzle support ring 32 is generally angular in configuration and has a forwardly extending nosepiece or shround 50. This shroud 50 overhangs the electrode 20 so as to protect the electrode and prevent inadvertent contact of the electrode with foreign objects.

At its rearward end the nozzle support ring 32 has a radial flange 51 extending outwardly from the ring. This flange 51 is engageable by an inwardly extending flange section 52 of the nozzle retaining nut 35 such that when the nut is threaded onto the threaded section 37 of the body extension, the flange 52 of the nut engages the flange 51 of the nozzle support ring and secures the ring 32 onto the end of the body 11.

A stepped axial bore 60 extends through the nozzle supporting ring 32. This bore is coaxially aligned with the central passage 34 in the gun body extension 26. Mounted within this bore 60 is the nozzle adapter 31. The adapter 31 has a flange 61 extending outwardly from its inner end and engaged with a shoulder 62 of the bore 60. This flange is maintained in abutment with the shoulder by engagement of a tapered forward end section 63 of the plug 33 with a tapered inner end section 64 of a bore 65 which extends through the adapter 31. The tapered section 64 of the bore 65 has a slightly greater angle or taper than does the forward end section 63 of the plug 33. As a consequence of this slightly differing taper, the forwardmost end 66 of the tapered surface 63 of the plug 33 engages the tapered surface 64 of the adapter and maintains sealing contact between the bore 65 of the adapter and the peripheral surface of the plug 33.

The nozzle 30 is fixedly secured in the forward end section of the bore 65 in the adapter 31. In a preferred embodiment, the adapter is made from stainless steel and the nozzle is made from a hardened material, as for example, tungsten carbide. To secure the nozzle within the bore 65 the nozzle may be brazed therein.

The plug 33 is made from an electrically nonconductive material, as for example nylon. At its rearward end it has a second tapered surface 70 engageable with a tapered surface 71 of the bore 34 in the body extension 26. The taper 70 of the end of the plug is slightly less than the taper of the section 71 of the bore 34 such that the inner end 72 of the plug contacts and forms a tight seal between the axial bore of the body extension 26 and the peripheral surface 70 of the plug 33. The length of the plug is such that when the retaining nut 35 is threaded onto the extension 26, the tapered end surfaces 63 and 70 of the plug are forced into contact with the tapered surfaces 64, 71 of the adapter 31 and body extension 26 respectively such that the plug is sandwiched between the two and a tight seal is formed between these surfaces.

Internally of the sealing plug 33 there is an axial bore 80 which is colinerally aligned with the bore 34 in the body extension 26 and the bore 65 of the adapter 31 (and consequently the bore 81 of the nozzle). This bore 80 is stepped and has an intermediate section 83 within which there is mounted a restrictor 84. This restrictor 84 is press-fit into the bore 80 of the plug and if fixed against axial displacement by engagement of a shoulder 86 of the bore with the forward end surface 87 of the restrictor. There is a restricted axial passageway 88 extending through the restrictor 84 and coaxially aligned with the end orifice 90 of the nozzle 30. The purpose of the restrictor 84 is to break up laminar flow of liquid to the nozzle. The presence of the restrictor 84 within the passageway 80 has the effect of creating turbulence in the liquid between the restrictor and the nozzle. This turbulence in turn eliminates tails on the edges of a fan-shaped pattern of liquid emerging from the nozzle. These tails are detrimental to the spray pattern and tend to produce a heavy stripe of sprayed material at the opposite edges of the spray pattern. By properly positioning the restrictor 84 within the passage 80 these tails are eliminated from the resulting spray pattern. In practice, the positioning of the restrictor from the end of the nozzle has been found to be critical and to be in the range of between $\frac{1}{8}''$ and $\frac{1}{2}''$. In the preferred embodiment the restrictor is positioned $\frac{1}{4}''$ from the inner end of the nozzle. In other words, there is in the preferred embodiment a $\frac{1}{4}''$ gap between the nozzle and the restrictor. If the gap is decreased below the $\frac{1}{8}''$ dimension it has been found that the alignment between the bore of the restrictor and the bore of the nozzle becomes so critical that it is very nearly impossible to maintain. On the other hand, if the restrictor is positioned more than $\frac{1}{2}''$ from the nozzle, it has been found that the restrictor does not sufficiently break up the laminar flow to the nozzle as to eliminate the undesirable tails in the pattern of spray emanating from the nozzle orifice 90.

In operation, actuation of the trigger 13 of the gun establishes electrical contact between the source of electrical power 18 and the metal charging electrode 20 through the electrical circuit contained internally of the gun. This circuit includes the resistor 39, the electrical contact pin 41, the contact 43, pin 45, and washer 48, all of which are made of electrically conductive materials. This electrical circuit establishes a high voltage potential on the electrode 40. Simultaneously, actuation of the trigger interconnects the high pressure source 15 of liquid material to the nozzle 30 of the gun such that an atomized spray emanates from the nozzle and passes through the electrostatic field established by the electrode 20. This field is of sufficient strength that it imparts a charge to the atomized particles of liquid emerging from the nozzle such that a greater percentage of the particles are deposited on articles or workpieces than would be deposited in the absence of the electrical charge.

Other than the elements of the electrical circuit, none of the components of the nozzle assembly other than the nozzle 30 and nozzle adapter 31 are made from an electrically conductive material. Specifically, the gun extension body 26, the nozzle support ring 32, the nozzle retaining nut 35, and the sealing plug 33 are all made from electrically non-conductive materials. The mass of the electrically conductive nozzle 30 and adapter 31 are sufficiently small and the surface area of the two exposed to atmosphere is sufficiently small that there is no tendency for electrical current to arc between the electrode 20 and the nozzle 30 or adapter 31. Furthermore, the effective capacitance of the nozzle assembly is sufficiently low that even if the electrode of the gun is shorted to a grounded object, such as the workpiece toward which the spray is directed, the energy level of the resulting spark is sufficiently low that the spark will not ignite an explosive atmosphere within which the gun may be operating.

Another advantage of the invention of this application is attributable to the use of the double taper sealing plug 33 and the manner in which it is tapered relative to the tapered seats 70 and 63 of the body extension 26 and adapter 31 respectively. Specifically, the tapered ends of the plug have less taper than the seats 70, 63 which they contact. Consequently, tightening of the nozzle retainer nut 35 onto the body extension 26 has the effect of pulling the tapered ends of the plug into substantially line contact with their respective seats rather than surface contact such as would result if the taper of the plug and seats were identical. This line contact is advantageous for maintaining a good seal even as the surfaces wear between the plastic body extension 26 and the plastic (nylon in the preferred embodiment) plug 33 and between the metal adapter 31 and plastic plug. This seal eliminates the need for O-rings or any other form of rubber or resilient seal such as is commonly employed in high pressure airless spray gun nozzle assemblies.

While we have described only a single preferred embodiment of our invention, persons skilled in the art to which this invention pertains will readily appreciate numerous changes and modifications which may be made without departing from the spirit of our invention. Therefore, we do not intend to be limited except by the scope of the following appended claims:

We claim:

1. An airless electrostatic spray apparatus comprising, an elongated body of insulating material having two passages therethrough, one of said passages being adapted to be connected with a supply of liquid coating material under sufficient pressure to effect airless atomization of said liquid coating, valve means for controlling flow of liquid coating material through said one passage, electrical circuit means including electrical resistor means in the other of said passages, said circuit means being adapted to be connected to a source of electrical potential, and a nozzle assembly comprising a nozzle mounting ring of insulative material having an axial passage therethrough, said axial passage of said nozzle mounting ring being coaxially aligned with said one passage of said elongated body, a nozzle support adapter, said adapter having an axial passage therethrough and being mounted within said axial passage of said mounting ring, said adapter being a single unitized piece of electrically conductive material, an electrically conductive airless spray nozzle, said nozzle being fixedly mounted within said axial passage in said adapter, electrically non-conductive sealing means operable between said adapter and said elongated body, and an electrode mounted within said nozzle mounting ring, said electrode being electrically connected to said electrical circuit means but electrically insulated from said electrically conductive nozzle, the mass of said electrically conductive nozzle and nozzle support adapter being sufficiently small and having a sufficiently low capacitance that there is no tendency for electrical current in said circuit means to arc between said electrode and said nozzle or nozzle support adapter and being sufficiently low in capacitance that any spark generated between said nozzle assembly and a grounded object is of a minimal safe energy level.

2. The apparatus of claim 1 in which said electrical circuit means includes an electrically conductive washer mounted in said nozzle mounting ring, and an electrical lead mounted in said elongated body and having a contact engageable with said washer.

3. The apparatus of claim 1 which further includes a retainer nut of insulating material threaded onto said elongated body and engageable with said nozzle mounting ring to secure said nozzle mounting ring onto said elongated body and to compress said sealing means between said adapter and said elongated body.

4. The apparatus of claim 1 in which said sealing means includes a double conical sealing plug located between said adapter and said elongated body, said double conical sealing plug having an axial passage therethrough coaxially aligned with said one passage of said elongated body and said axial passage of said adapter.

5. The apparatus of claim 4 in which said double conical sealing plug has a first tapered end surface sealingly engaged with a correspondingly tapered portion of said one passage in said elongated body, and a second end tapered surface engaged with a correspondingly tapered portion of said axial passage of said adapter.

6. The apparatus of claim 4 which further includes a flow restrictor contained within said axial passage of said double conical sealing plug.

7. The apparatus of claim 1 in which said sealing means has an axial passage therein, said axial passage of said sealing means being coaxially aligned with said one bore of said elongated body and with said axial passage of said adapter.

8. The apparatus of claim 7 which further includes a flow restrictor mounted within said axial passage of said sealing means.

9. The apparatus of claim 8 wherein said first restrictor is positioned a distance of between $\frac{1}{8}''$ and $\frac{1}{2}''$ from said nozzle.

10. An airless electrostatic spray apparatus comprising, an elongated body of insulating material having two passages therethrough, one of said passages being adapted to be connected with a supply of liquid coating material under sufficient pressure to effect airless atomization of said liquid coating, valve means for controlling flow of liquid coating material through said one passage, electrical circuit means including electrical resistor means in the other of said passages, said circuit means being adapted to be connected to a source of electrical potential, a nozzle mounting ring of insulative material having an axial passage therethrough, said axial passage of said nozzle mounting ring being coaxially aligned with said one passage of said elongated body, a nozzle supporting adapter having an axial passage therethrough and being mounted within said axial passage of said mounting ring, said adapter being a single unitized piece of electrically conductive material, an electrically conductive airless spray nozzle, said nozzle being mounted within said axial passage in said adapter, electrically non-conductive sealing means operable between said adapter and said elongated body, said sealing means comprising a double conical sealing plug, said plug having a first end tapered portion tapered in a first direction engaged with a substantially correspondingly tapered portion of said one passage in said elongated body, and a second end tapered portion tapered in an opposite direction and engaged with a substantially tapered portion of said axial passage of said adapter, and an electrode mounted within said nozzle mounting ring, said electrode being electrically connected to said electrical circuit means, the mass of said electrically conductive nozzle and nozzle support adapter being sufficiently small and having a sufficiently low capacitance that there is no tendency for electrical current in said circuit means to arc between said electrode and said nozzle or nozzle supporting adapter and being sufficiently low in capacitance that any spark generated between said nozzle or nozzle supporting adapter and a grounded object is of a minimal safe energy level.

11. The apparatus of claim 10 in which said electrical circuit means includes an electrically conductive washer mounted in said nozzle mounting ring, and an electrical lead mounted in said elongated body and having a contact engageable with said washer.

12. The apparatus of claim 10 which further includes a retainer nut of insulating material threaded onto said elongated body and engageable with said nozzle mounting ring to secure said ring onto said elongated body and to compress said sealing plug between said adapter and said elongated body.

13. The apparatus of claim 10 in which said sealing plug has an axial passage therein, and a flow restrictor contained within said axial passage of said sealing plug.

14. The apparatus of claim 10 in which said sealing plug has an axial passage therein, said axial passage of said sealing plug being coaxially aligned with said one bore of said elongated body and with said axial passage of said adapter.

15. The apparatus of claim 14 which further includes a flow restrictor mounted within said axial passage of said sealing plug.

16. The apparatus of claim 15 wherein said flow restrictor is positioned a distance of between $\frac{1}{8}''$ and $\frac{1}{2}''$ from said nozzle.

17. The apparatus of claim 10 in which said tapered first and second end portions of said plug differ slightly in angulation from the tapered portion of the passages of said elongated body and adapter respectively so that the tapered end portions of said plug establish substantially line contact with the tapered portion of the passages of said elongated body and adapter respectively.

18. An airless spray apparatus comprising, an elongated body having a central passage therethrough, said passage being adapted to be connected with a supply of liquid coating material under sufficient pressure to effect airless atomization of said liquid coating, valve means for controlling flow of liquid coating material through said one passage, a nozzle mounting ring of insulative material having an axial passage therethrough, said axial passage of said nozzle mounting ring being coaxially aligned with said passage of said elongated body, a nozzle supporting adapter, said adapter having an axial passage therethrough and being mounted within said axial passage of said mounting ring, an airless spray nozzle, said nozzle being mounted within said axial passage in said adapter, and a unitary, non-elastomeric sealing means operable between said adapter and said elongated body, said sealing means comprising a double conical plastic sealing plug, said plug having a first end tapered portion tapered in one direction and engaged with a substantially correspondingly tapered portion of said passage in said elongated body, and a second end tapered portion tapered in an opposite direction and engaged with a substantially correspondingly tapered portion of said axial passage of said adapter.

19. The apparatus of claim 18 in which said tapered first and second end portions of said plug differ slightly in angulation from the tapered portions of the passages of said elongated body and adapter respectively so that the tapered end portions of said plug establish substantially line contact with the tapered portions of the passages of said elongated body and adapter respectively.

* * * * *

UNITED STATES PATENT AND TRADEMARK OFFICE

CERTIFICATE OF CORRECTION

PATENT NO. : 4,355,764

DATED : October 26, 1982

INVENTOR(S) : Alvin A. Rood and Donald R. Hastings

It is certified that error appears in the above—identified patent and that said Letters Patent is hereby corrected as shown below:

Column 3, line 47, before "50" "shround" should be -- shroud --

Column 4, line 37, after "and" "if" should be -- is --

Claim 9, column 7, line 7, "first" should be -- flow --

Signed and Sealed this

First Day of February 1983

[SEAL]

Attest:

GERALD J. MOSSINGHOFF

Attesting Officer

Commissioner of Patents and Trademarks